US008555950B2

(12) United States Patent
Fabros

(10) Patent No.: US 8,555,950 B2
(45) Date of Patent: Oct. 15, 2013

(54) ORGANIC-LIKE CASTING PROCESS FOR WATER JACKETS

(75) Inventor: Charles Fabros, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/280,654

(22) Filed: Oct. 25, 2011

(65) Prior Publication Data

US 2013/0098574 A1 Apr. 25, 2013

(51) Int. Cl.

| | |
|---|---|
| ***B22C 9/00*** | (2006.01) |
| ***B22C 1/00*** | (2006.01) |
| ***B22C 9/10*** | (2006.01) |

(52) U.S. Cl.
USPC ..... 164/15; 164/520; 164/369

(58) Field of Classification Search
USPC ..... 164/15, 520, 369
See application file for complete search history.

(56) References Cited

U.S. PATENT DOCUMENTS

| | | | |
|---|---|---|---|
| 4,446,906 | A | 5/1984 | Ackerman et al. |
| 4,616,600 | A | 10/1986 | Hirano |
| 4,693,294 | A | 9/1987 | Albrecht et al. |
| 5,217,059 | A | 6/1993 | Kuhn et al. |
| 5,423,372 | A | 6/1995 | Kearney |
| 5,669,339 | A | 9/1997 | Yukawa et al. |
| 6,886,505 | B2 | 5/2005 | Laufenberg et al. |
| 6,899,064 | B2 | 5/2005 | Hughes et al. |
| 7,891,402 | B2 | 2/2011 | Keys, Sr. et al. |
| 8,029,614 | B2 | 10/2011 | Zenpo et al. |
| 2005/0247428 | A1 | 11/2005 | Cantu-Gonzalez et al. |
| 2009/0139475 | A1 | 6/2009 | Roozenboom et al. |

FOREIGN PATENT DOCUMENTS

| | | | |
|---|---|---|---|
| CN | 2668872 | Y | 1/2005 |
| EP | 1595617 | A1 * | 11/2005 |
| JP | 3027863 | A | 2/1991 |

* cited by examiner

*Primary Examiner* — Kevin P Kerns
*Assistant Examiner* — Steven Ha
(74) *Attorney, Agent, or Firm* — Damian Porcari; MacMillan, Sobanski & Todd, LLC

(57) ABSTRACT

Heat flow and mechanical strength of an engine component are improved by an organic-like casting core. Hardened granules are formed of a core material having a three-dimensional solid shape. A secondary binder is applied to the hardened granules. A multiplicity of the granules are agglomerated in a master mold in a shape of a water jacket of the engine component, and the secondary binder is hardened to form an organic-like core having a continuous web structure. A plurality of other cores are formed in respective master molds to define respective surfaces of the engine component. The organic-like core is assembled with the other cores to form a casting mold. The engine component is cast by flowing molten metal into the casting mold, thereby forming a continuous parent metal bridging the water jacket having a predetermined porosity. The core material is removed from the engine component after casting.

2 Claims, 4 Drawing Sheets

ORGANIC-LIKE CASTING PROCESS FOR WATER JACKETS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to molten metal casting of engine components such as cylinder blocks and cylinder heads, and, more specifically, to a process and casting core for improving the structure of a water jacket (i.e., cooling passage) to improve heat flow and mechanical strength.

Cylinder blocks and cylinder heads are examples of engine components for internal combustion engines that are typically manufactured by casting an aluminum alloy in a mold made from hardened sand cores. Water jackets (i.e., cooling passages) formed in cylinder blocks and heads using existing casting methods result in a forced compromise between efficiency of heat transfer and the structural support and rigidity of the cast part. Water jackets provide a method of heat transfer from engine components to the cooling system. To efficiently move heat from the engine itself into the coolant flowing in the water jacket, the water jacket is separated from the heat source by only a thin wall of the cast metal. However, thin sections of minimally supported material exhibit reduced strength to react against mechanical and combustion loads. Due to the lack of support, the load carrying ability of the structure in the vicinity of the water jacket can be significantly affected by small changes in material wall thickness between the water jacket cavity and the cylinder or combustion chamber. The structural requirements due to the lack of structure in the areas of the water jacket may necessitate more material thickness/volume to provide structural performance even though less material thickness would provide for better heat transfer and cooling.

It would be desirable to reduce wall thickness for better cooling efficiency while maintaining wall strength for better mechanical performance.

SUMMARY OF THE INVENTION

In one aspect of the invention, a method is provided for casting an engine component. Hardened granules are formed of a core material having a three-dimensional solid shape. A secondary binder is applied to the hardened granules. A multiplicity of the granules are agglomerated in a master mold in a shape of a water jacket of the engine component, and the secondary binder is hardened to form an organic-like core having a continuous web structure. A plurality of other cores are formed in respective master molds to define respective surfaces of the engine component. The organic-like core is assembled with the other cores to form a casting mold. The engine component is cast by flowing molten metal into the casting mold, thereby forming a continuous parent metal bridging the water jacket having a predetermined porosity. The core material is removed from the engine component after casting.

DETAILED DESCRIPTION OF PREFERRED EMBODIMENTS

Figure 1:
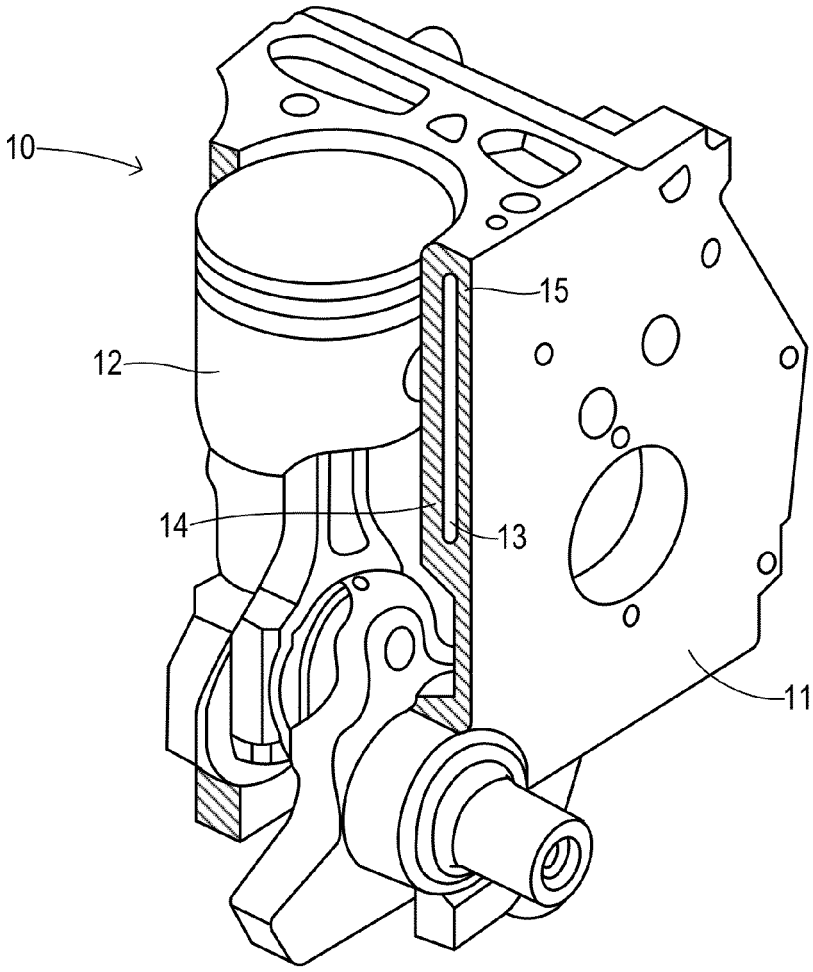
FIG. 1 is a perspective view of an engine block cross section to reveal an internal water jacket.

The present invention generally replaces some or all of the water jacket with a porous metal cast with defined voids throughout. This organic-like casting (OLC) is similar to a sponge or open-cell honeycomb, wherein material and voids are spread throughout the structure. A liquid (i.e., coolant) flow volume that passes through the pores of the material depends of the structure of the voids throughout the metal, and has a predetermined void/volume ratio (i.e., the total three-dimensional volume of the voids divided by the total volume of the water jacket region). A conventional water jacket would have a void/volume ratio of 1. That same water jacket completely blocked (e.g., filled with epoxy) would have a void/volume ratio of 0. The OLC water jacket structure of the present invention has a void/volume ratio somewhere between 1 and 0, and the structural versus cooling flow characteristics are tuned by adjusting this ratio. As the ratio is increased, flow volume increases and structural support decreases. As the ratio is reduced, the flow volume decreases and the structural support increases.

The OLC water jacket shape is made by forming the water jacket core as an organic-like core using discrete spheres or other geometric shapes made from conventional core materials. As these discrete shapes contact each other, the remaining air space defines a matrix structure that will remain as the metal of the engine block in the cast metal part. With spheres used as the mold fill, as the sphere diameter is increased the void/volume ratio increases allowing more flow volume for the liquid coolant. As sphere diameter is decreased the reverse happens, to the point that the sphere size is the same as the sand grain particle size and there would be no voids created in the structure. The OLC process can be thought of as causing intentional, controlled porosity in the cast part.

The invention provides a two step mold-making process for the jackets. First, the fill shape (i.e., granules) must be formed and hardened in a quantity required to fill a mold for the core. The granules may be formed as sand ball bearings, for example. Then the mold is filled with these pre-hardened shapes along with a secondary binding agent to bond the individual granules to each other within the OLC core. The granule shape and size is varied as required to get the correct balance of structure and flow. Other cores for the cylinder block are formed/hardened separately using conventional materials and assembled into a full core assembly along with the composite core for the water jacket. The full core assembly may be glued and hardened to bind all the separate cores together. The core assembly is then used in the same manner as a conventional core to cast an engine block.

In some instances, breaking out the sand cores from the engine block or head after the casting may be an issue due to the many discrete core elements and the porosity of the water jacket. An alternate mold fill material such as salt or other materials that dissolve in liquid could be used in those instances, with the other aspects of the invention being unchanged.

The resulting water jacket has a low void/volume ratio with a well defined, continuous supporting matrix of cast material throughout with superior structural characteristics while achieving a sufficient flow of cooling medium. The OLC process and design of this invention has the advantage that the nominal wall thicknesses between the water jacket and cylinder or combustion chamber can be significantly reduced because the structure is continuously supported on the water jacket side without long unsupported sections of relatively thin wall section as is the case with a conventional jacket. With this reduction in nominal wall thickness, the effective heat transfer is greatly increased allowing better control of material temperatures within the engine. Due to the improved structural characteristics in the area of the water jacket, the wall thickness can be reduced for better cooling performance while overall engine component strength can be significantly increased due to the continuous nature of the internal matrix that is formed by this process. This avoids other less-desirable ways of obtaining structural improvement such as incorporating discrete ribs in the water jacket which inhibit water flow in the supported area and also tend to cause local stress risers in critical areas. The continuous nature of the OLC jacket minimizes stress risers while providing maximum support.

Referring now to FIG. 1, a portion of an engine 10 includes a cylinder block 11 containing a piston assembly 12. Cylinder block 11 is shown partially in cross-section to reveal a water jacket 13 between walls 14 and 15. Coolant circulating through water jacket 13 removes heat generated by combustion. Although a cylinder block is shown in this example, the invention equally applies to cylinder heads and any other cast components containing a water jacket or other cooling passage.

Cylinder block 11 may be formed using a casting process in which separate sand cores are joined in an assembly for defining the areas to be occupied by the metal of the cylinder block. After casting, the sand from the cores returns to a loose shape and can be poured out from the cylinder block.

Figure 2:
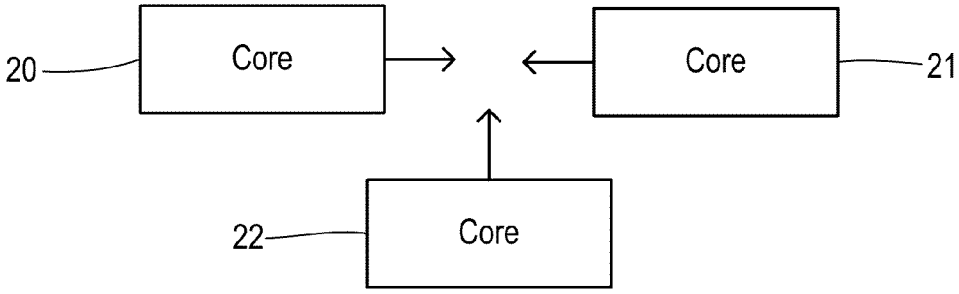
FIG. 2 is a block diagram showing assembly of cores to form a casting mold.
Figure 3:
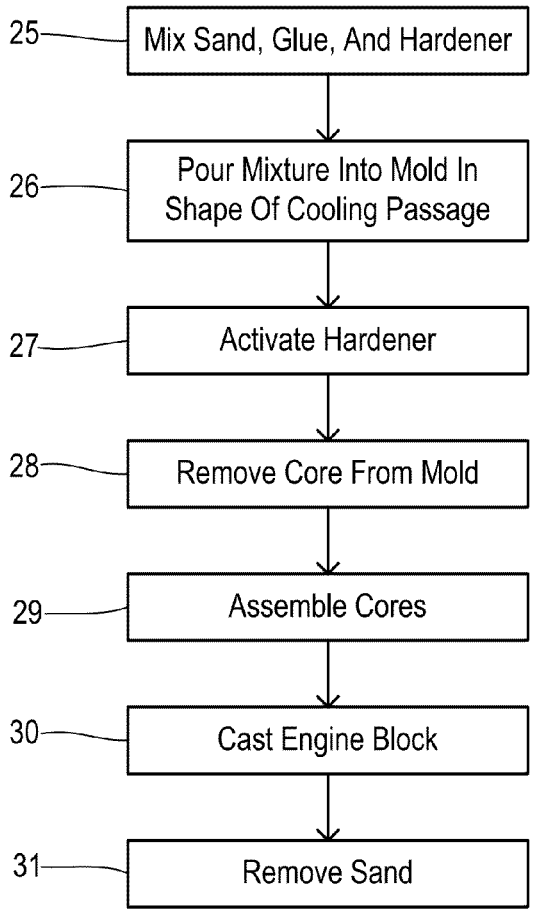
Fig. 3 (Prior Art)
FIG. 3 is a flowchart showing a prior art casting process.
Figure 4:
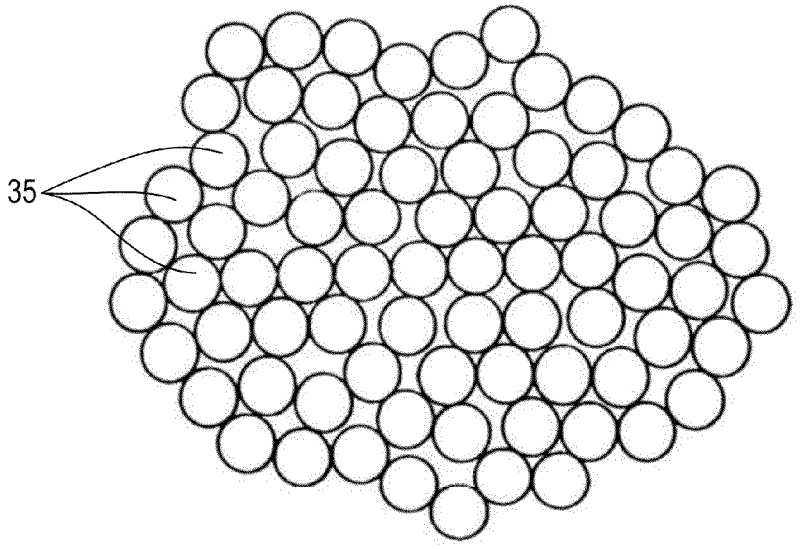
FIG. 4 depicts a plurality of spherical granules for forming an organic-like core of the present invention.

As shown in FIG. 2, a plurality of core elements 20-22 are joined in a core assembly. The overall conventional casting process is shown in FIG. 3. Each separate core element is made in step 25 by mixing sand, glue, and a hardener. The mixture is poured or blown into a mold for defining each separate core element, such as a mold shape to create the water jacket or other cooling passage in step 26. With the mixture in the mold, the hardener is activated in step 27 (e.g., by heating the mixture). After hardening, each core element is removed from its mold in step 28. In step 29, the cores are assembled into a full casting mold. Using the assembled mold, the engine block is cast in step 30. After other processing steps, the sand may be removed in step 31.

According to the prior art process, a core corresponding to the water jacket is a solid body defining the void shape of the water jacket. The present invention employs granules agglomerated into an overall shape of the water jacket such that there are continuous voids within the core to allow inflow of the cast metal to create a porous body for the water jacket. In one preferred embodiment, spheres or spheroids 35 may be incorporated into the agglomeration. Various three-dimensional solid shapes can be employed for the granules. In order to provide a continuous void in the cast part for allowing coolant flow, the organic-like core has a continuous web structure. The continuous web is created by ensuring that each granule touches adjacent granules. To promote proper contact, a significant portion of the surface of each granule is preferably convex. The void between granules in the core is likewise substantially continuous in order to form the engine block with a continuous parent metal bridging the water jacket having a predetermined porosity. The porosity is determined by the size and shape of the granules. Spheres or spheroids with diameters in a range of about 1 millimeter to about 5 millimeters can be employed. More preferably, the diameters may range between about 2 millimeters and about 4 millimeters. In one preferred embodiment, the granules may be made of conventional core materials (e.g., sand, glue, and hardener) and formed using molds with a plurality of receptacles for forming the individual granules.

Figure 5:
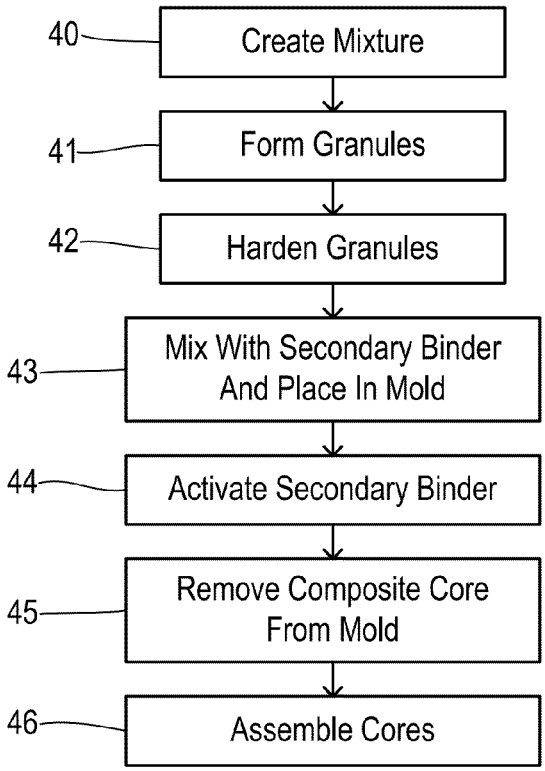
FIG. 5 is a flowchart showing one preferred method of the invention.

A method of the invention is shown in greater detail in FIG. 5. A mixture of core material is created in step 40 and formed into granules in step 41. The granules are hardened in step 42 and then mixed with a secondary binder and placed in a master mold defining the water jacket core in step 43. The primary and secondary binders may be comprised of either inorganic or organic binders as known in the art. A conventional phenol-formaldehyde binder could be used, for example. The sand may be zircon sand, for example. The secondary binder is activated in step 44 to harden. After hardening, an organic-like core having a continuous web structure is formed within the master mold. The core comprises an agglomeration of a multiplicity of the granules. After removing the composite organic-like core from the master mold in step 45, it is assembled with the other conventional cores for the cylinder block in step 46.

Figure 6:
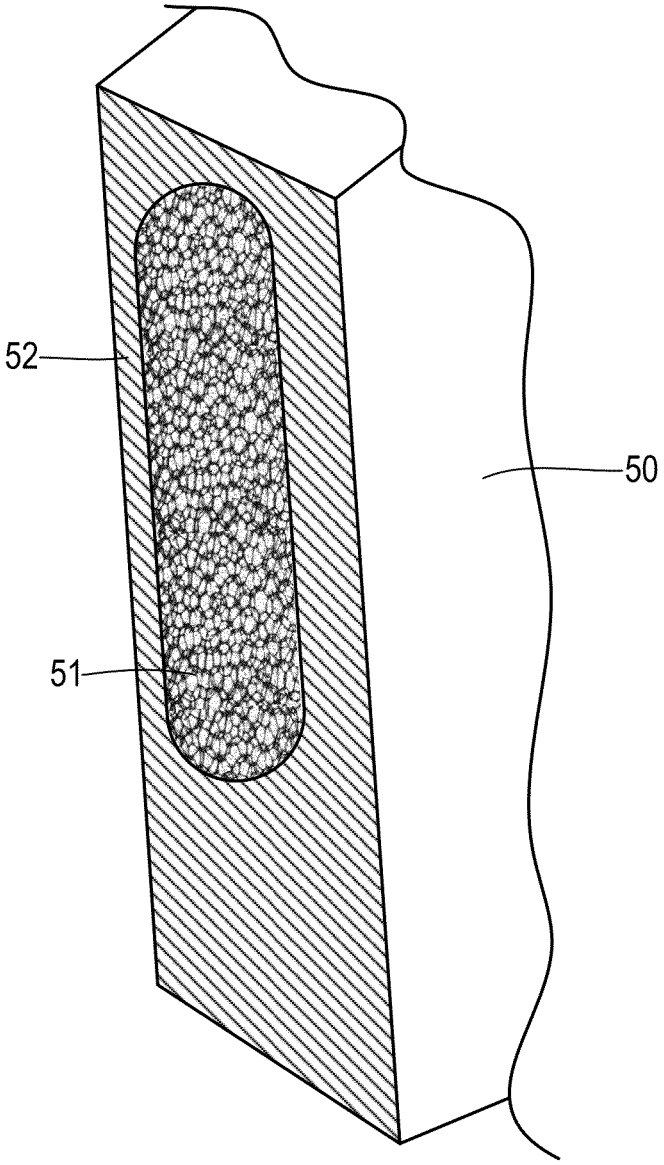
FIG. 6 is a cross-sectional view showing a cast engine block of the present invention.

After casting, a cylinder block 50 is obtained as shown in cross-section in FIG. 6. A water jacket 51 has a porous structure between solid walls, including a wall 52 facing an adjacent piston cylinder. Wall 52 may be thinner than was obtained in the prior art due to the increased mechanical strength supplied by the web within water jacket 51.

Figure 7:
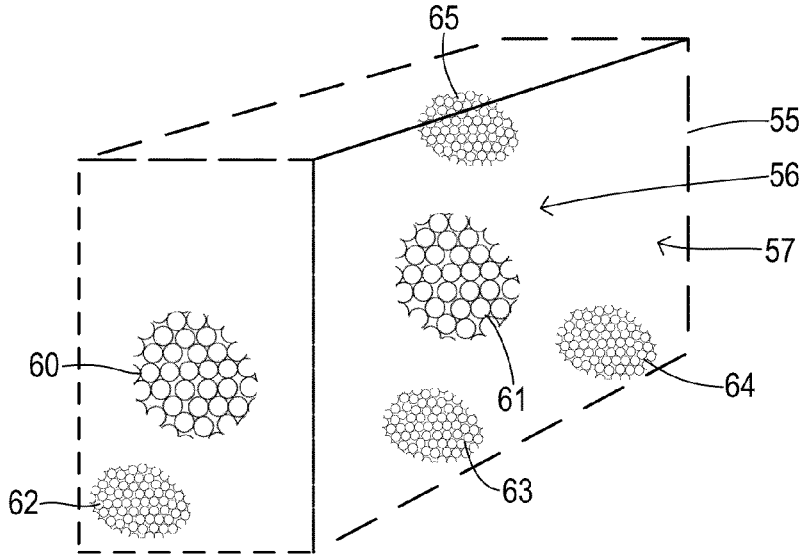
FIG. 7 is a perspective view showing differently sized granules in different regions of an organic-like core.

In another embodiment of the invention, the diameter of individual granules placed in different positions within the organic-like core may vary. The resulting void/volume ratio would then also vary in different regions within the water jacket to thereby allow increased coolant flow in some areas and increased mechanical strength in other areas. As shown in FIG. 7, a core 55 for a water jacket may have a central region 56 and an edge region 57. Granules of two different sizes are employed; a group of large diameter granules and a group of small diameter granules. Central region 56 mainly comprises granules of the larger diameter and edge region 57 mainly comprises granules of the smaller diameter. As illustrated, groups of larger granules 60 and 61 are agglomerated in center region 56 with a highest concentration of larger granules, while groups of smaller granules 62-65 are provided with a highest concentration in edge region 57. By higher concentration, it is meant that the population of granules is predominately either granules from the group of larger or smaller granules, respectively. Some mixing of granule sizes within any region may be acceptable or even desirable depending on the desired characteristics.

What is claimed is:

1. A method of casting an engine component, comprising the steps of:

forming hardened granules of a core material having a three-dimensional solid shape;

applying a binder to the hardened granules;

agglomerating a multiplicity of the granules in a master mold in a shape of a water jacket of the engine component and hardening the binder to form an organic-like core having a continuous web structure;

forming a plurality of other cores in respective master molds to define respective surfaces of the engine component;

assembling the organic-like core with the other cores to form a casting mold;

casting the engine component by flowing molten metal into the casting mold, thereby forming a continuous parent metal bridging the water jacket having a predetermined porosity; and removing the core material from the engine component after casting;

wherein the multiplicity of granules includes a group of smaller granules and a group of larger granules wherein the larger granules all have a maximum diameter greater than the maximum diameter of the smaller granules, and wherein the multiplicity of granules are agglomerated in the master mold with a highest concentration of larger granules in a center region of the organic-like core and a highest concentration of smaller granules in an edge region of the organic-like core.

2. A method of casting an engine component, comprising the steps of:

forming hardened granules of a core material having a three-dimensional solid shape by placing a sand and glue mixture in a granular mold and then hardening the mixture;

applying a binder to the hardened granules;

agglomerating a multiplicity of the granules in a master mold in a shape of a water jacket of the engine component and hardening the binder to form an organic-like core having a continuous web structure;

forming a plurality of other cores in respective master molds to define respective surfaces of the engine component;

assembling the organic-like core with the other cores to form a casting mold;

casting the engine component by flowing molten metal into the casting mold, thereby forming a continuous parent metal bridging the water jacket having a predetermined porosity; and removing the core material from the engine component after casting.

* * * * *